US010519975B2

(12) United States Patent
Tiedtke et al.

(10) Patent No.: US 10,519,975 B2
(45) Date of Patent: Dec. 31, 2019

(54) COMPRESSOR STAGE

(71) Applicant: MAN Diesel & Turbo SE

(72) Inventors: Alf-Peter Tiedtke, Muehlheim an der Ruhr (DE); Matthias Wollnik, Gladbeck (DE)

(73) Assignee: MAN Energy Solutions SE, Augsburg (DE)

( * ) Notice: Subject to any disclaimer, the term of this patent is extended or adjusted under 35 U.S.C. 154(b) by 829 days.

(21) Appl. No.: 15/105,041

(22) PCT Filed: Dec. 16, 2014

(86) PCT No.: PCT/EP2014/003377

§ 371 (c)(1),
(2) Date: Jun. 16, 2016

(87) PCT Pub. No.: WO2015/090566

PCT Pub. Date: Jun. 25, 2015

(65) Prior Publication Data

US 2016/0319838 A1 Nov. 3, 2016

(30) Foreign Application Priority Data

Dec. 17, 2013 (DE) ..... 10 2013 020 825
Feb. 17, 2014 (DE) ..... 10 2014 001 998

(51) Int. Cl.
*F04D 29/42* (2006.01)
*F04D 27/00* (2006.01)
(Continued)

(52) U.S. Cl.
CPC ..... *F04D 29/4213* (2013.01); *F04D 17/10* (2013.01); *F04D 27/001* (2013.01);
(Continued)

(58) Field of Classification Search
None
See application file for complete search history.

(56) References Cited

U.S. PATENT DOCUMENTS 5,611,663 A * 3/1997 Kotzur ..... F01D 15/08 415/122.1
2016/0061206 A1* 3/2016 Taketomi ..... F04D 27/001 415/118

FOREIGN PATENT DOCUMENTS

| | | |
|---|---|---|
| DE | 3909180 | 9/1990 |
| DE | 102004038523 | 3/2004 |
| JP | H08121381 | 5/1996 |

* cited by examiner

*Primary Examiner* — Kayla McCaffrey
(74) *Attorney, Agent, or Firm* — Cozen O'Connor

(57) ABSTRACT

Compressor stage with a stator-side intake connection piece via which medium which is to be compressed can be introduced into the compressor stage in the region of the compressor stage, with a stator-side inflow channel via which the medium to be compressed can be conveyed in direction of a rotor-side impeller proceeding from the intake connection piece, wherein the impeller has a radially inner hub, a radially outer cover disk and impeller blades extending between the hub and the cover disk, wherein a plus measuring point and a minus measuring point are provided at the compressor stage for measuring the effective pressure at the compressor stage, and wherein the minus measuring point is positioned upstream of the impeller outside of the stator-side inflow channel in an annular gap which branches off from the inflow channel.

8 Claims, 3 Drawing Sheets

(51) Int. Cl.
*F04D 17/10* (2006.01)
*F04D 29/16* (2006.01)

(52) U.S. Cl.
CPC ..... *F04D 29/162* (2013.01); *F05B 2240/14* (2013.01); *F05B 2240/20* (2013.01); *F05B 2270/3011* (2013.01); *F05B 2270/3015* (2013.01)

COMPRESSOR STAGE

PRIORITY CLAIM

This is a U.S. national stage of application No. PCT/EP2014/003377, filed Dec. 16, 2014. Priority is claimed on the following applications: DE 102013020825.4 and DE 102014001998.5, filed on Dec. 17, 2013 and Feb. 17, 2014, the content of which is/are incorporated herein in its entirety by reference.

FIELD OF THE INVENTION

The invention is directed to a compressor stage including the measurement of effective pressure.

BACKGROUND OF THE INVENTION

Compressor stages known from practice have assemblies on the stator side and assemblies on the rotor side. The stator-side assemblies of a compressor stage include an intake connection piece via which medium which is to be compressed can be introduced into the compressor stage in the region of the compressor stage. The stator-side assemblies further include a stator-side flow channel via which the medium to be compressed can be conveyed in direction of a rotor-side impeller proceeding from the intake connection piece. The rotor-side impeller has a radially inner hub, a radially outer cover disk and also rotor-side impeller blades extending between the hub and the cover disk. A gap formed between the rotor-side cover disk and the stator is sealed via a seal which is held by a seal carrier.

For a compressor stage of the type mentioned above to operate in an optimal manner, it is important to know the volume flow of the compressor stage, which is determined through a measurement of differential or effective pressure. To this end, it is known from practice to provide or construct what are known as a plus measuring point and a minus measuring point at the compressor stage for measuring the effective pressure at the compressor stage. The plus measuring point is typically arranged in the region of a relatively large cross-sectional flow area and accordingly in the region of a relatively high static flow pressure, and the minus measuring point is arranged in the region of a relatively small cross-sectional flow area and accordingly in the region of a relatively low static flow pressure. Based on the pressure difference between the plus measuring point and the minus measuring point, a signal can be acquired for the measurement of effective pressure.

Although it is already known to provide a plus measuring point and a minus measuring point at compressor stages for measurement of effective pressure, there is a need for a compressor stage at which the measurement of effective pressure can be carried out in a particularly advantageous manner, particularly with high accuracy.

SUMMARY OF THE INVENTION

On this basis, it is an object of the present invention to provide a novel compressor stage. According to the invention, the minus measuring point is positioned upstream of the impeller outside of the stator-side inflow channel in an annular gap which branches off from the inflow channel.

With the present invention, it is proposed for the first time to position the minus measuring point for the measurement of effective pressure in an annular gap, i.e., outside of the stator-side inflow channel upstream of the impeller, which annular gap branches off from the inflow channel. There is a circumferentially averaged pressure distribution in the annular gap so that the measurement of effective pressure is not dependent on the specific positioning of the minus measuring point viewed in circumferential direction. The inhomogeneous flow influences affecting the measurement of effective pressure in the region of the minus measuring point are eliminated by arranging the minus measuring point in the annular gap. A bore diameter for a bore which leads to the annular gap from radially outside and via which the existing pressure in the annular gap can be tapped or diverted can be freely selected because the pressure at the minus measuring point is tapped in the region of the annular gap outside of the inflow channel.

The annular gap preferably branches off radially outward from the stator-side inflow channel immediately upstream of the impeller. This allows a particularly advantageous measurement of effective pressure because the pressure is lowest directly upstream of the impeller and accordingly, relative to the plus measuring point, the greatest pressure gradient can be utilized for the measurement of effective pressure.

According to an advantageous further development, the annular gap is bounded adjacent to the impeller by a stator-side seal carrier which carries a seal cooperating with the cover disk of the rotor-side impeller. Opposite the impeller, the annular gap is bounded by a stator-side housing or by a stator-side inlet star which is fastened to the stator-side housing. This arrangement is constructed in a simple manner and allows an optimal positioning of the minus measuring point for the measurement of effective pressure.

According to another advantageous further development, the annular gap is formed in a chamber-like manner, the minus measuring point being positioned in a chamber-like portion of the annular gap. The pressure in the region of the minus measuring point for measurement of effective pressure can be further homogenized in the chamber-like portion, so that the measurement of effective pressure can be further improved.

BRIEF DESCRIPTION OF THE DRAWINGS

Embodiment examples of the invention are described more fully with reference to the drawings without the invention being limited to these embodiment examples. The drawings show.

DETAILED DESCRIPTION OF THE PRESENTLY PREFERRED EMBODIMENTS

The present invention is directed to a compressor stage, particularly a compressor stage of a radial compressor. However, the details according to the invention can also be utilized in a compressor stage for an axial compressor.

Figure 1:
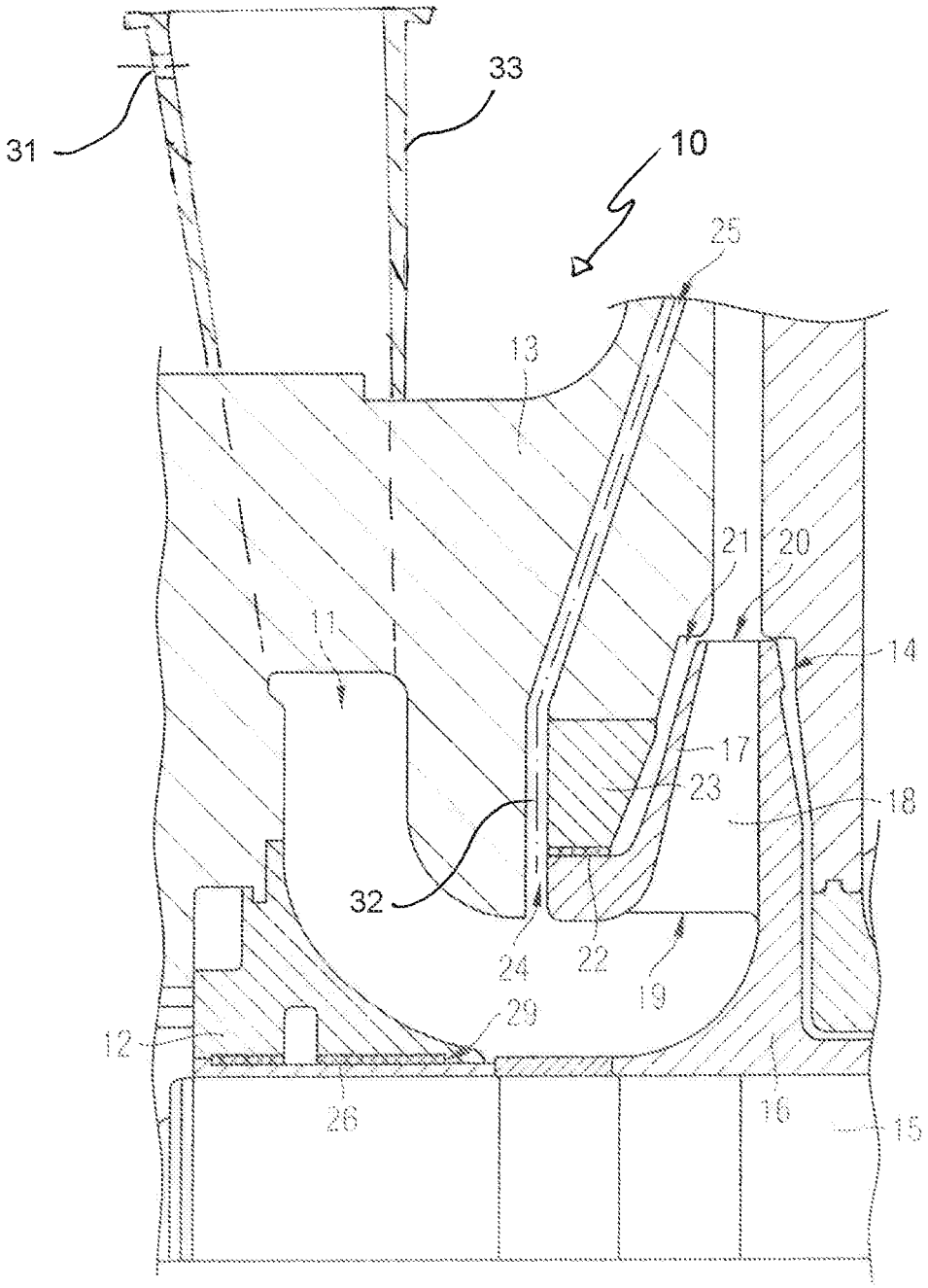
FIG. 1 a detail of a first embodiment of a compressor stage according to the invention in meridional section.

FIG. 1 shows a detail of a first embodiment of a compressor stage 10 according to the invention. The compressor stage 10 shown in FIG. 1 is the compressor stage of a radial compressor.

The compressor stage 10 has a stator-side intake connection piece 33, shown in FIG. 1, via which medium which is to be compressed can be introduced into the compressor stage 10 or sucked into the compressor stage 10.

The medium to be compressed can be conveyed to a rotor-side impeller 14 of the compressor stage 10 via a stator-side inflow channel 11 which, in the present embodiment example, is bounded radially inwardly by a stator-side seal carrier 12 and radially outwardly by a stator-side housing 13.

The rotor-side impeller 14 has a shaft 15 with a radially inner hub 16, a radially outer cover disk 17 and impeller blades 18 extending between the hub 16 and the cover disk 17. A flow inlet edge 19 and a flow outlet edge 20 of the impeller blades 18 are shown in FIG. 1.

A gap 29 which is formed between the rotor-side shaft 15 of the impeller 14 and the stator-side seal carrier 12 is sealed via a seal 26 supported by this stator-side seal carrier 12.

A gap 21 which is formed between the stator-side housing 13 and the cover disk 17 of the rotor-side impeller 14 is sealed by a seal 22 which is held by a further stator-side seal carrier 23.

A plus measuring point 31 is associated with the compressor stage 10 for measurement of effective pressure in the region of the intake connection piece, as shown in FIG. 1, via which medium to be compressed can be supplied to the compressor stage. Accordingly, the plus measuring point for the measurement of effective pressure is positioned in the region of the intake connection piece in the region of a relatively large cross-sectional flow area and, accordingly, in the region of a relatively high static flow pressure.

A minus measuring point 32 for the measurement of effective pressure is positioned upstream of the impeller 14 outside of the stator-side inflow channel 11 in an annular gap 24 branching off from the inflow channel. In the embodiment example shown in the drawing, the annular gap 24 branches off radially outward from the stator-side inflow channel 11 directly upstream of the impeller 14. The minus measuring point 32 is positioned in the region of a relatively small cross-sectional flow area and, therefore, in the region of a relatively small flow pressure.

A bore 25 leads from the radially outer side to this annular gap 24 and opens into the annular gap 24. The pressure prevailing in the annular gap 24 and, therefore, at the minus measuring point 32 can be diverted or tapped via this bore 25 for measuring effective pressure.

A circumferentially averaged pressure level occurs in the annular gap 24 which extends radially outward over the entire circumferential extension of the inflow channel 11 and branches off from it so that the pressure which can be tapped for the measurement of effective pressure in the region of the minus measuring point accordingly does not depend on the exact circumferential position at which the bore 25 opens into the annular gap 24.

Further, inhomogeneous flow influences on the pressure in the region of the minus measuring point can be minimized as far as possible in this way.

A further advantage of the invention consists in that virtually any bore diameter can be selected for bore 25. Since the pressure in the annular gap 24 is extensively independent from the flow influences of the flow in the inflow channel 11, there is no need with regard to the bore diameter of bore 25 to compromise between the greatest possible operating reliability against clogging with impurities and signal quality with the least possible influence on the flow in the inflow channel 11.

In the embodiment example of FIG. 1, the annular gap 24 is bounded on the side facing the impeller 14 by the seal carrier 23 on one hand and by a front portion of the cover disk 17 on the other hand. In FIG. 1, the annular gap 24 is bounded directly by the stator-side housing 13 on the side opposite the impeller 14.

Figure 2:
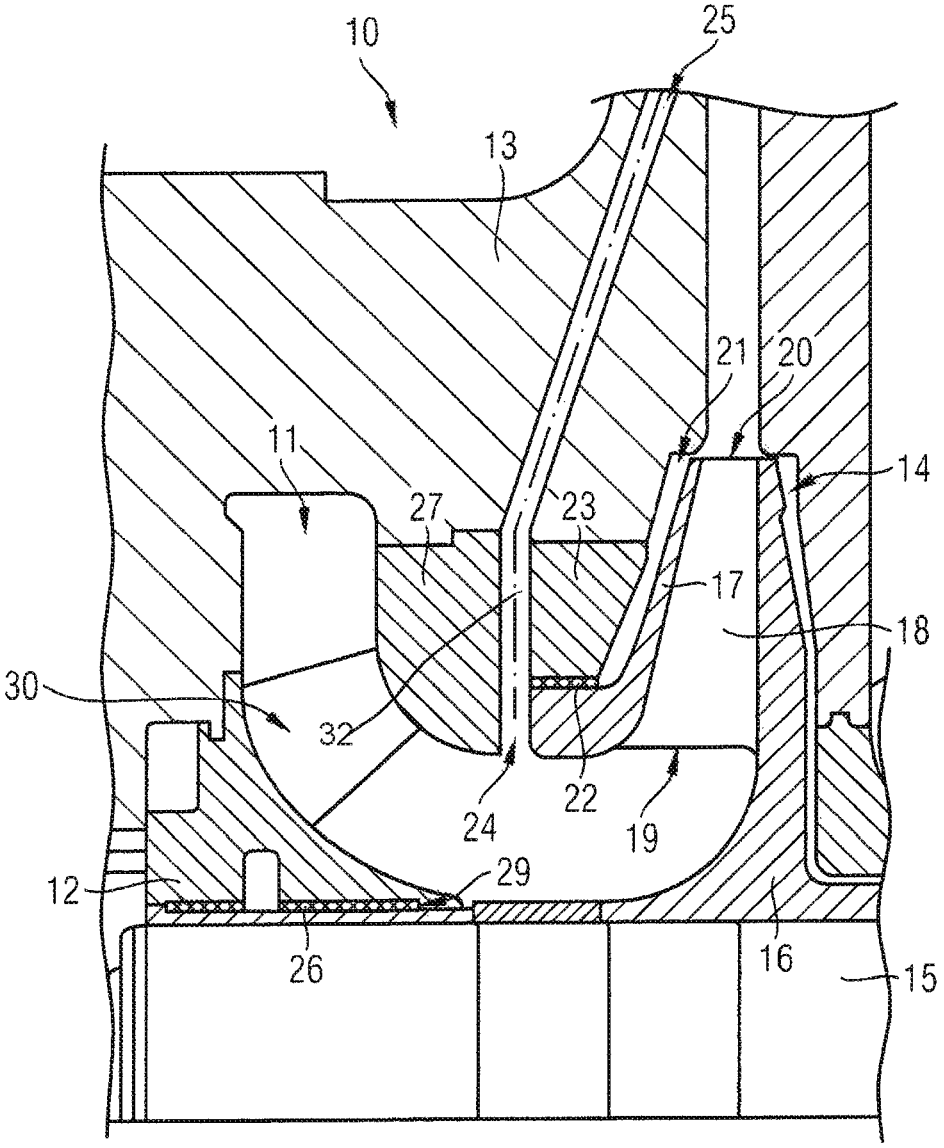
FIG. 2 a detail of another embodiment of a compressor stage according to the invention in meridional section.

FIG. 2 shows a second embodiment example of a compressor stage 10 according to the invention. Only those details which distinguish the embodiment example in FIG. 1 from the embodiment example in FIG. 2 will be addressed in the following. As regards all of the rest of the details for the embodiment example in FIG. 2, reference is made to the description of the embodiment example in FIG. 1. The same reference numerals are used for the same assemblies in the embodiment examples of FIGS. 1 and 2.

The embodiment example of FIG. 2 differs from the embodiment example of FIG. 1 merely in that in the embodiment example of FIG. 2 there is additionally a stator-side inlet star 27 with inlet guide blades 30 which partially bounds the stator-side inflow channel 11 on the radially outer side; and the annular gap 24, in the area of which the minus measuring point for the measurement of effective pressure is positioned, is bounded on the side remote of the impeller 14 by this stator-side inlet star 27.

Figure 3:
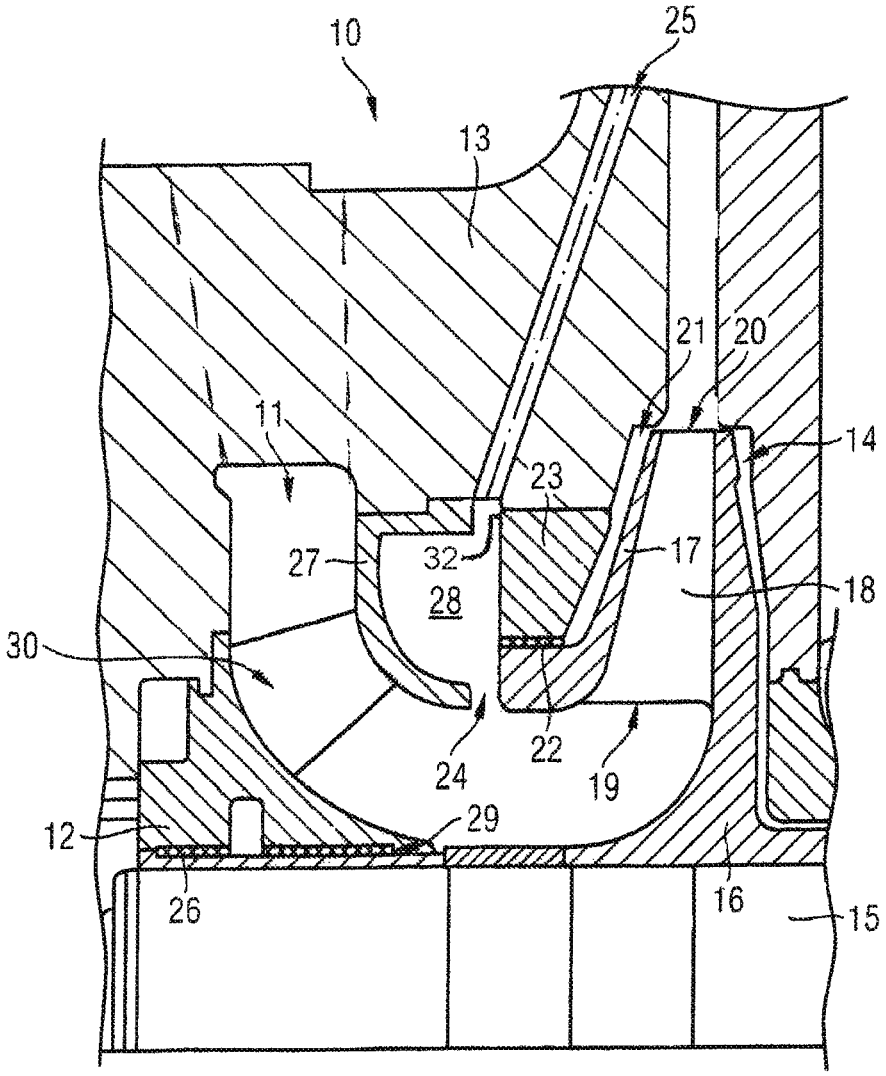
FIG. 3 a detail of a third embodiment of a compressor stage according to the invention in meridional section

FIG. 3 shows a further embodiment example of a radial compressor stage 10 according to the invention. The embodiment example of FIG. 3 differs from the embodiment example of FIG. 2 merely in that the annular gap 24 which is bounded on the side remote of the impeller 14 by the inlet star 27 is formed in a chamber-like manner or is widened in a chamber-like manner, the minus measuring point being positioned in the region of a chamber-like portion 28 of the annular gap 24. A further homogenizing of the pressure level can take place in this chamber-like portion 28 so that the signal quality can be further improved at the minus measuring point for measuring effective pressure.

Accordingly, in the compressor stage 10 the plus measuring point is positioned at a portion with the greatest possible cross section and, therefore, with the highest possible pressure, preferably in the region of the intake connection piece 33, shown in FIG. 1. The minus measuring point of the measurement of effective pressure is positioned in the region of the smallest possible flow cross section and, therefore, in the region of the lowest possible pressure, namely, according to the invention, in an annular gap 24 which branches off from the stator-side inflow channel 11 upstream of the impeller 14, preferably radially outwardly directly upstream of the inflow channel 11. The pressure level in the annular gap is circumferentially averaged and, accordingly, does not depend on the circumferential position. The signal quality at the minus measuring point can be further improved via a chamber-shaped widening of the annular gap 24 as shown in FIG. 3. The pressure for the minus measuring point can be tapped at any circumferential position via a bore 25 ending in the annular gap 24. The bore 25 extends exclusively through the housing 13 and accordingly need not bridge or cross any constructional component boundaries. A further advantage of the invention consists in that as a result of the positioning of the minus measuring point there is no risk that the minus measuring point will become clogged due to soiling.

The compressor stage 10 according to the invention is preferably a radial compressor stage. However, the invention can also be used in a compressor stage for an axial compressor.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A compressor stage comprising:

a radial stator-side intake connection piece (33) configured to radially introduce a medium to be compressed into the compressor stage;

a rotor-side impeller (14);

a stator-side inflow channel (11) having a circumferential extension and configured to convey the medium to be compressed in direction of the rotor-side impeller (14) proceeding from the intake connection piece, wherein the impeller (14) comprises a radially inner hub (16), a radially outer cover disk (17) and impeller blades (18) extending between the hub (16) and the cover disk (17); an annular gap (24) branching off from the inflow channel (11);

a stator-side seal carrier (23) and a seal (22);

a plus measuring point (31) and a minus measuring point (32) provided at the compressor stage for measuring the effective pressure at the compressor stage, the minus measuring point (32) positioned upstream of the impeller (14) outside of the stator-side inflow channel (11) in the annular gap (24); and wherein the annular gap (24) extends radially outward over the entire circumferential extension of the inflow channel and is bounded adjacent to the impeller (14) by the stator-side seal carrier (23) which carries the seal (22) that cooperates with the cover disk (17) of the rotor-side impeller (14).

2. The compressor stage according to claim 1, wherein the annular gap (24) is bounded opposite the impeller (14) by a stator-side housing (13).

3. The compressor stage according to claim 1, wherein the annular gap (24) is formed as a chamber, and wherein the minus measuring point (32) is positioned in the chamber (28) of the annular gap (24).

4. The compressor stage according to claim 1, additionally comprising a bore (25) leading to the minus measuring point (32) from radially outward for tapping an existing pressure level at the minus measuring point (32).

5. The compressor stage according to claim 1, wherein the plus measuring point (31) is positioned in the region of the intake connection piece (33).

6. The compressor stage according to claim 1, wherein the compressor stage is a radial compressor stage.

7. A compressor stage comprising:

a stator-side intake connection piece (33) for introducing a medium to be compressed into the compressor stage;

a rotor-side impeller (14);

a stator-side inflow channel (11) for conveying the medium to be compressed in direction of the rotor-side impeller (14) proceeding from the intake connection piece, wherein the impeller (14) comprises a radially inner hub (16), a radially outer cover disk (17) and impeller blades (18) extending between the hub (16) and the cover disk (17); an annular gap (24) branching off from the inflow channel (11);

a stator-side seal carrier (23) and a seal (22);

a plus measuring point (31) and a minus measuring point (32) provided at the compressor stage for measuring the effective pressure at the compressor stage, the minus measuring point (32) positioned upstream of the impeller (14) outside of the stator-side inflow channel (11) in the annular gap (24); and wherein the annular gap (24) is bounded adjacent to the impeller (14) by the stator-side seal carrier (23) which carries the seal (22) that cooperates with the cover disk (17) of the rotor-side impeller (14), wherein the annular gap (24) branches off radially outward from the stator-side inflow channel (11) immediately upstream of the impeller (14).

8. A compressor stage comprising:

a stator-side intake connection piece (33) for introducing a medium to be compressed into the compressor stage;

a rotor-side impeller (14);

a stator-side inflow channel (11) for conveying the medium to be compressed in direction of the rotor-side impeller (14) proceeding from the intake connection piece, wherein the impeller (14) comprises a radially inner hub (16), a radially outer cover disk (17) and impeller blades (18) extending between the hub (16) and the cover disk (17); an annular gap (24) branching off from the inflow channel (11);

a stator-side seal carrier (23) and a seal (22);

a plus measuring point (31) and a minus measuring point (32) provided at the compressor stage for measuring the effective pressure at the compressor stage, the minus measuring point (32) positioned upstream of the impeller (14) outside of the stator-side inflow channel (11) in the annular gap (24); and wherein the annular gap (24) is bounded adjacent to the impeller (14) by the stator-side seal carrier (23) which carries the seal (22) that cooperates with the cover disk (17) of the rotor-side impeller (14) and opposite the impeller (14) by a stator-side housing (13), wherein the annular gap (24) is bounded opposite the impeller (14) by a stator-side inlet star (27) which is fastened to the stator-side housing (13).

* * * * *